US006662796B2

(12) United States Patent
St. Cyr

(10) Patent No.: US 6,662,796 B2
(45) Date of Patent: Dec. 16, 2003

(54) ARROW REST

(76) Inventor: Stephen St. Cyr, 194 Academy Hill, Newcastle, ME (US) 04553

( * ) Notice: Subject to any disclaimer, the term of this patent is extended or adjusted under 35 U.S.C. 154(b) by 0 days.

(21) Appl. No.: 10/072,389

(22) Filed: Feb. 5, 2002

(65) Prior Publication Data

US 2003/0024517 A1 Feb. 6, 2003

Related U.S. Application Data

(60) Provisional application No. 60/266,519, filed on Feb. 5, 2001.

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | |
|---|---|---|---|---|
| 3,945,368 A | | 3/1976 | Jones | |
| 4,671,249 A | | 6/1987 | Troncoso | |
| 4,686,956 A | | 8/1987 | Troncoso, Jr. | |
| 4,697,350 A | | 10/1987 | Shepley et al. | |
| 4,791,907 A | | 12/1988 | Corley | |
| 4,803,971 A | | 2/1989 | Fletcher | |
| 4,899,716 A | * | 2/1990 | Martin et al. | 124/44.5 |
| 5,042,450 A | | 8/1991 | Jacobson | |
| 5,052,364 A | * | 10/1991 | Martin et al. | 124/44.5 |
| 5,085,201 A | | 2/1992 | Tepper et al. | |
| 5,117,803 A | | 6/1992 | Johnson | |
| 5,144,937 A | | 9/1992 | Colvin | |
| 5,251,606 A | | 10/1993 | Colvin | |
| 5,261,383 A | * | 11/1993 | Halamay | 124/44.5 |
| 5,419,303 A | | 5/1995 | Stewart | |
| 5,462,041 A | * | 10/1995 | Solecki | 124/44.5 |
| 5,482,025 A | | 1/1996 | Finkel | |
| 5,490,492 A | | 2/1996 | Savage | |
| 5,606,962 A | | 3/1997 | Troncoso | |
| 5,673,678 A | | 10/1997 | Savage | |
| 5,944,004 A | | 8/1999 | Goff et al. | |

OTHER PUBLICATIONS

Cabela's Catalogue, pp. 29–30 (published prior to Feb. 2001).

* cited by examiner

*Primary Examiner*—John A. Ricci

(57) ABSTRACT

An improved arrow rest including a base and laterally moving arrow-supporting arms is disclosed. The arrow rest provides a support to steady the arrow allowing a user to aim and launch an arrow with accuracy, which also accommodates for the deflections of an arrow during flight, thereby ensuring that no other forces but those of the bow string affect the flight of the arrow. The arrow rest is simple in design, economical to manufacture, adjustable to allow for different arrow shaft and arrow feather sizes, and durable.

10 Claims, 8 Drawing Sheets

ARROW REST

CROSS-REFERENCE TO RELATED APPLICATIONS

This application claims priority under 35 U.S.C. §119(e)(1) to U.S. Provisional Application No. 60/266,519, filed Feb. 5, 2001, which is incorporated herein in its entirety.

TECHNICAL FIELD

This invention relates to new and useful improvements in arrow rests for archery bows.

BACKGROUND OF THE INVENTION

Archers use accessory-type arrow rests attached to archery bows to increase the accuracy of their shots. Arrow rests can provide supports to steady the arrow when the arrow is drawn through the bow. These supports can form a cradle for the arrow to rest upon. It is, however, desirable that the arrow rest not interfere with the flight of the arrow as this interference can affect the accuracy of a shot.

When an arrow is launched from a bow, large driving forces are placed on the arrow by the bowstring, causing the arrow shaft to deflect. This deflection can be in a lateral direction, a vertical direction, or a combination of both. Supports of an arrow rest that cannot adequately accommodate for these deflections may interfere with the arrow's flight. In other words, the support may not be able to adequately yield to the forces exerted on it by the deflections of the arrow. Instead, by not yielding, the support may exert its own force on the arrow, pushing the arrow off its course. Interference can also result if the arrow rest is not designed to allow the arrow's tail feathers or vanes to freely pass through the arrow rest. Such interference can also throw the arrow off course and/or damage the arrow's feathers or vanes. In addition, care should be taken to ensure that the mechanisms to prevent these interferences do not themselves place undesirable forces upon the arrow.

The arrow rest may possess other desirable characteristics. For example, the arrow rest should work quietly. Any noise from using the arrow rest, such as when the arrow is being drawn across the supports, might warn the target of the hunter's presence and cause it to flee before the hunter is prepared to shoot. The arrow rest should also create minimal frictional drag on the arrow, as this may slow down the arrow and interfere with shooting accuracy. It is further desirable that the arrow rest be economical to manufacture and durable through the rigors of hunting.

SUMMARY OF THE INVENTION

With the foregoing in mind, the present invention relates to an arrow rest designed to possess the desirable characteristics of an arrow rest and eliminate, or substantially alleviate, the disadvantages of arrow rests known in the prior art.

In one general aspect, the invention includes a base and a pair of opposing arrow-supporting arms pivotally coupled to the base. The arms may move independently of each other to yield to forces exerted upon the arms by an arrow in flight. In this manner, the arrow rest would not interfere with the normal flight of the arrow. Additionally or alternatively, the arms may move in a motion wherein the arms move away from and towards the center of the arrow rest. The motion may be in a generally horizontal direction with respect to the base. In other embodiments, the motion may be in a generally vertical direction with respect to the base.

In some embodiments, the arrow rest may include an elastically compliant, resilient member coupled to the arms for biasing the arms to a home position. The home position may be defined by a stop coupled to, or otherwise integrally formed with, the base.

In some embodiments, a wheel may be coupled to a distal end of each arm. The wheels may form a cradle upon which one can rest and steady an arrow to be shot from a bow. The wheels may also provide some traction for the arrow, for example by an O-ring placed around the periphery of the wheel. In other embodiments, the arms may terminate in prongs that form a cradle.

In still other embodiments, the wheels may be coupled to the arms by an adjustment device. The adjustment device can be used to vary the spacing between the arrow rest wheels to accommodate arrow shafts of varying sizes.

In one aspect of the invention, an arrow rest may include a base; a pair of arrow-supporting arms pivotally coupled to the base; a pair of wheels, each wheel coupled to a distal end of the arms; a stop coupled to the base defining a home position for the arms; and an elastically compliant, resilient member coupled to each arm for biasing the arms to the home position.

These and other objects, along with advantages and features of the present invention herein disclosed, will become apparent to those skilled in the art through reference to the following description of various embodiments of the invention, the accompanying drawings, and the claims.

BRIEF DESCRIPTION OF THE DRAWINGS

In the drawings, like reference characters refer to the same parts throughout the different views. Also, the drawings are not necessarily drawn to scale, emphasis instead generally being placed upon illustrating the principles of the invention.

DETAILED DESCRIPTION

Embodiments of the present invention are described below. It is, however, expressly noted that the present invention is not limited to these embodiments, but rather the invention is that all equivalents and modifications that are obvious to a person skilled in the art are also included.

Figure 1:
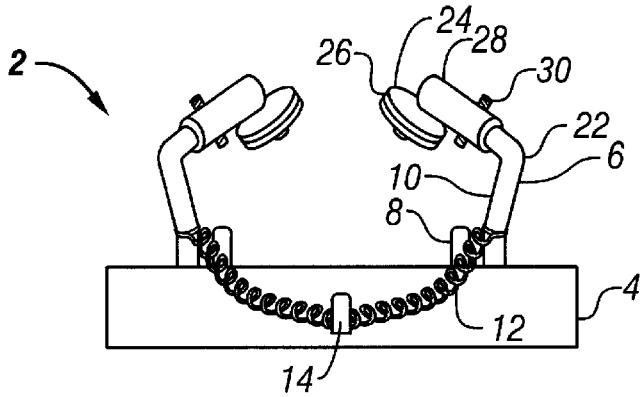
FIG. 1 is a frontal view of one embodiment of the present invention.
Figure 2:
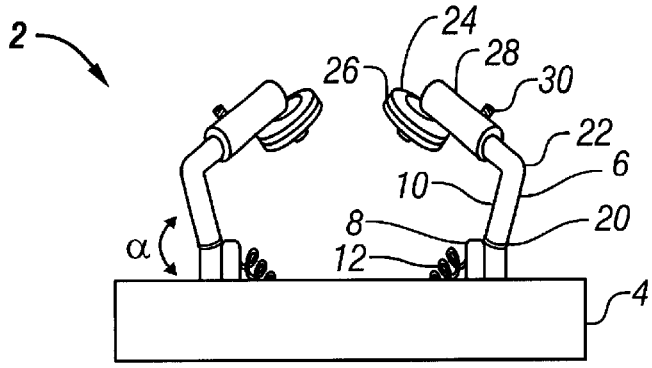
FIG. 2 is a rear view of the embodiment shown in FIG. 1.
Figure 3:
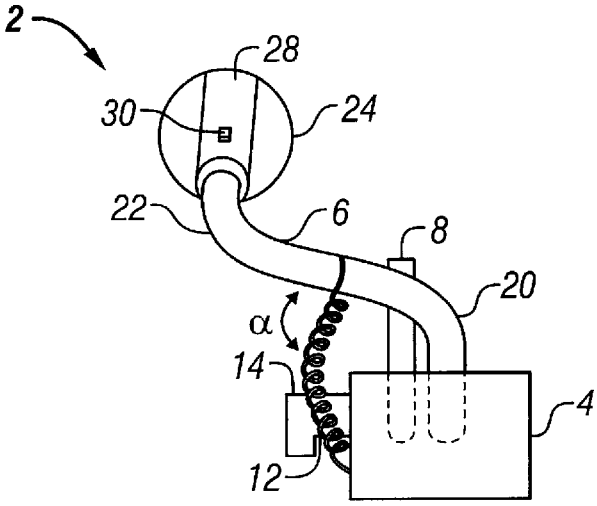
FIG. 3 is a side view of the embodiment shown in FIG. 1.

FIGS. 1,2, and 3 depict front, rear, and side views of one embodiment of the present invention. The arrow rest 2 includes a base 4 and a pair of opposing arrow-supporting arms 6. The arms 6 can be pivotally coupled to the base 4. For example, a proximal end of the arm 6 that may be circular in cross-section can be fit into a circular opening in the base 4 such that the arm 6 may pivot freely in the opening. Other means of pivotally coupling the arms 6 to the base 4 will be apparent to those skilled in the art.

In the present embodiment, the freely pivoting arms 6 can be maintained in a home position by stops 8 disposed on the base 4 to an interior side 10 of the arms 6. The stops 8 may be of any size and shape which limits the inward pivoting of the arms 6 to define the home position, but does not otherwise affect the workings of the arrow rest 2. The stops 8 may be attached to the base 4 by any means known in the art, including, but not limited to, friction, solder, screws, and glue.

An elastically compliant, resilient member, such as a spring 12, can be coupled to the arms 6 and used to bias the arms 6 toward the home position. The tension of the spring 12 should be such that the arms 6 will not spread apart from the weight of the arrow resting upon the arms 6, but will move to accommodate for the force applied on the arms 6 from the deflections of the released arrow. In addition, the spring 12 will bring the arms 6 toward the home position when the force is removed. The inward and outward movements of the arms 6 in relation to the center of the arrow rest, in general, are also known as lateral movements.

The present invention may also include a spring holding or retaining device 14 coupled to a front surface of the base 4. The spring holding device 14 can be used to secure the spring 12 in position and/or allow for smooth lateral movements. The spring 12 and spring holding device 14 can also be used to secure the arms 6 to the base 4. The spring 12, when engaged in the spring holding device 14, can place a downward force on the arms 6, preventing the arms 6 from falling out of the base 4.

Figure 4:
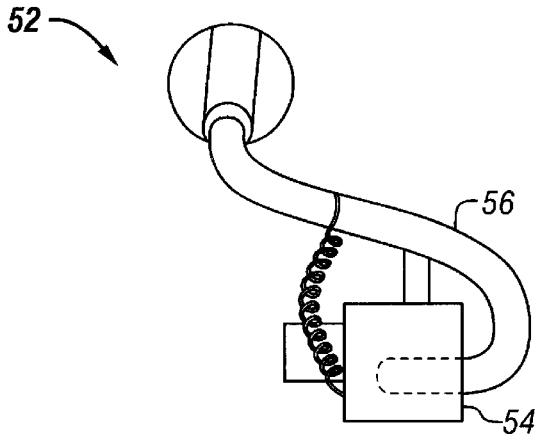
FIG. 4 is a side view of another embodiment of the present invention.

FIG. 4 depicts another embodiment of an arrow rest 52. The proximal end of the arms 56 is pivotally coupled to the back portion of the base 54. The resultant inward and outward movements of the arms 56 (lateral movements) will be in a generally vertical direction.

The shape of the arms 6 may be of any configuration, limited only in that the proximal end of the arms 6 be pivotally coupled to the base 4 and the distal end of the arms 6 be sufficiently spaced from each other to allow an arrow to rest thereupon and allow a space therebetween to allow for the passage of an arrow's feathers. An example of such a configuration is shown in the embodiment of FIGS. 1, 2, and 3. The arms 6 are shown as having a non-linear shape. In this embodiment, a first bend 20 in the arm 6 results in an angle $\alpha$ being formed by the arm 6 and an upper surface of the base 4. The arm 6 can extends from about the first bend 20 in a generally upward and outward direction until the arm 6 forms a second bend 22. The second bend 22 further extends the arm 6 in a generally upward and inward direction until the opposing arms 6 are sufficiently close to each other to form a cradle for the arrow. As one skilled in the art would appreciate, angle $\alpha$, arm length, and arm configuration can be manipulated to adjust the size of the cradle, to accommodate arrow shafts of various sizes, and to adjust the distance between the cradle and the base 4 through which an arrow's feathers would pass undamaged.

The distal end of the arms 6 form a cradle for the arrow. The distal end of the arms 6 may be of any configuration so long as each distal end provides at least one point of contact with the arrow to provide a cradle for the arrow and also creates a space therebetween to allow the arrow's feathers to pass through the arrow rest 2. The arms 6, or at least a portion of the arms 6, may be bare or they may be coated with a low friction material such as TEFLON® (DuPont). The wheels 24, as shown in the present embodiment, may form the cradle. The wheels 24 are coupled to the distal end of the arms 6 and tilted so that the wheels 24 may make minimal contact with the arrow. The contact should be sufficient to support the arrow, while minimizing the contact between the wheels 24 and the arrow to ensure minimal frictional drag on the arrow. Precision bearings may be used in the wheels 24 to ensure smooth rotation of the wheels 24. In preferred embodiments, each wheel 24 uses one precision bearing.

A band 26 of material may encompass the periphery of the wheel 24. This band 26 can provide traction for the arrow. Traction can aid in preventing the arrow from inadvertently slipping out of the cradle. Contact between the band 26 and the arrow is kept to a minimum to ensure minimal interference during the flight of the arrow. An example of this type of band may be a conventional O-ring. The O-ring may be made of any material such as plastic or rubber that may possess a smooth, substantially friction-free surface and which may provide a slight grip. One type of O-ring is manufactured from elastomeric polymers such as neoprene.

An adjustment device 28 can be used to couple the wheels 24 to the arms 6 as well as to adjust the size of the cradle formed between the wheels 24 and/or the contact between the wheel 24 and the arrow shaft. The adjustment device 28 may be a hollow, cylindrical-shaped structure disposed along the length of the arm 6. The wheels 24 may be attached to the adjustment device 28 by a screw, such as an Allen screw, through the precision bearing allowing for free rotation of the wheels 24. At least one screw 30, preferable two or more screws, is disposed on the adjustment device 28. The screw 30 is threaded through the barrel of the adjustment device 28 until it reaches the arm 6. The screw 30 is loosened to adjust the device 28 along the length of the arm 6 and/or about the circumference of the arm 6 and then re-tightened when the wheels 24 are properly adjusted.

Figure 5:
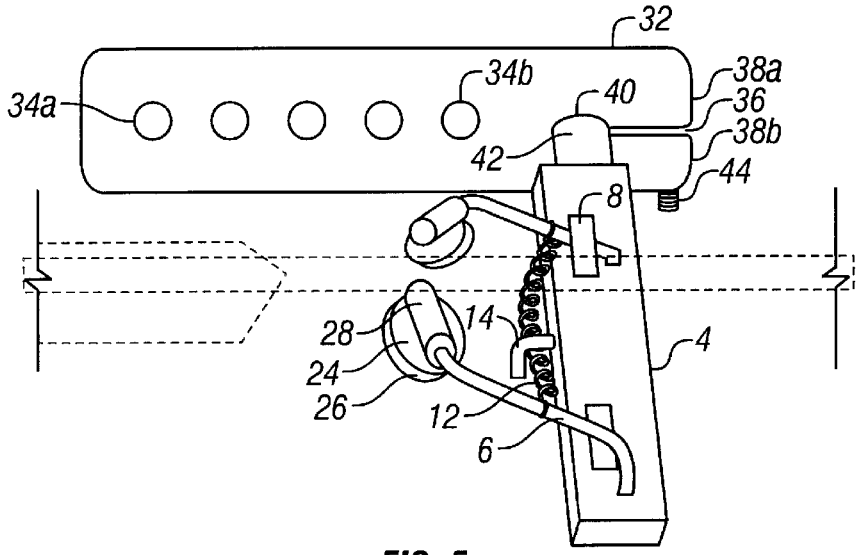
FIG. 5 is a perspective view of the embodiment shown in FIG. 1 in one embodiment of a mounting device with an arrow shown in phantom.

FIG. 5 shows a perspective view of the arrow rest 2 shown in FIGS. 1, 2, and 3 with a mounting device 32 for releasably mounting the arrow rest 2 to a bow. The mounting device 32 can be attached to the bow by any means known in the art, such as screws or nuts and bolts. The mounting element 32 includes a series of openings 34. The mounting device 32 can be attached to the bow at one of these openings 34. Bows have a 5/16-18 internal thread in the riser (the portion of the bow a user holds on to). A bolt can be put through one of the openings 34 and tightened to the riser. The selection of an opening 34 determines the distance of the arrow rest from the user. For example, attaching the mounting device 32 to the bow at opening 34*a* would place the arrow rest 2 the farthest from the user. Attaching the mounting device 32 at opening 34*b* places the arrow rest 2 the closest to the user.

Figure 6:
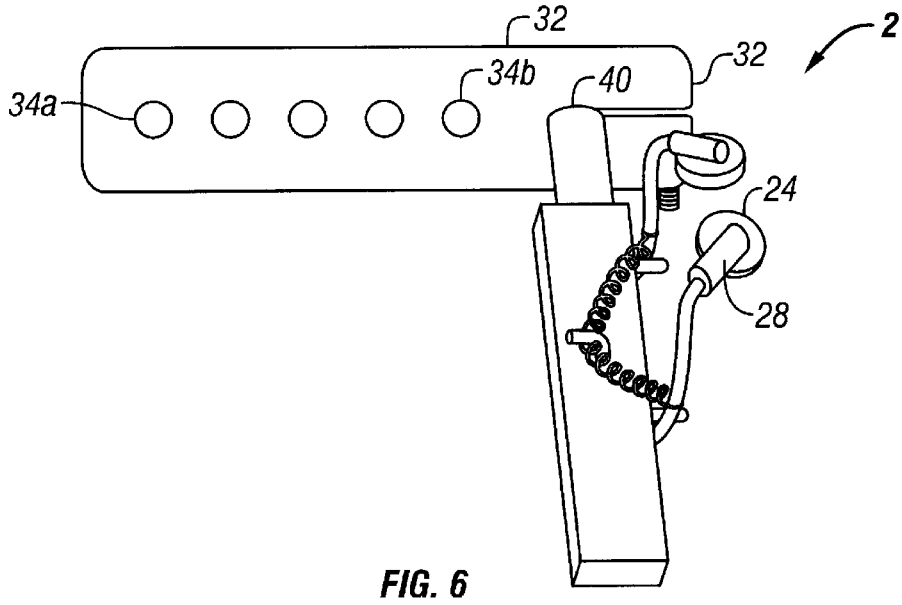
FIG. 6 is a perspective view of the embodiment shown in FIG. 1 adjusted to another position in the mounting device.

The arrow rest 2 may be integrally formed with the mounting device 32. Preferably, however, the arrow rest 2 and mounting device 32 are not integrally formed so that they may provide even more flexibility in adjusting the arrow rest 2 to a user's preference. For example, at one end of the mounting device 32 there may be a space 36 running lengthwise from the edge in towards the middle of the mounting device 32, creating an upper portion 38*a* of the mounting device 32 and a lower portion 38*b* of the mounting device 32. The space 36 may terminate in a circular opening to be used as a clamp 40. In one embodiment, a cylindrical appendage 42 may be attached to, or integrally formed with, one end the arrow rest 2. The free end of the cylindrical appendage 42 is placed through the clamp 40. A screw 44 may be used to join the upper portion 38*a* and lower portion 38*b* of the mounting device 32. By tightening the screw 44, the upper and lower portions 38*a*, 38*b* are pressed closer together, thereby, decreasing the size of the clamp 40. The mounting device 32 closes around the cylindrical appendage 42 like a vice, holding it in place. The screw 44 can be loosened to increase the size of the clamp 40 to allow for adjustments to the arrow rest 2 in relation to the mounting device 32 and re-tightened when the proper adjustment is made. For example, the arrow rest 2 can be rotated with respect to the mounting device 32 and/or moved closer or further away from the mounting device 32 by sliding the cylindrical appendage 42 through the clamp 40. FIG. 6 shows the arrow rest 2 and mounting device 32 of FIG. 5 with the arrow rest 2 rotated about 90° in the clamp 40 of the mounting device 32. The adjustment device 28 can then be used to re-adjust the wheel 24.

The arrow rest 2 and mounting device 32 can be used for a right-handed bow or a left-handed bow with some minor adjustments. For right-handed bows, the arrow rest 2 is mounted on the right side of the bow shaft. For a left-handed bow, the arrow rest 2 and mounting device 32 can be swung 180° about the bow shaft so that the arrow rest 2 is on the left side of the bow shaft. In the case of the embodiment shown in FIG. 5, when mounted for a right-handed user, the arrow rest 2 will be the furthest from the user. When mounted for a left-handed user, the arrow rest 2 can be swung about the riser of the bow and the mounting device 32 nearest to the user. In other words, when the arrow rest 2 is used for a right-handed user, the mounting device 32 is to the left of the arrow rest 2. Conversely, when the arrow rest 2 is used for a left-handed user, the mounting device 32 is to the right of the arrow rest 2. Another method of converting the arrow rest 2 from a right-handed device to a left-handed device is to loosen the clamp 40, slip out the arrow rest 2 from its position on the right side of the mounting device 32, and reattach it in the clamp 40 on the left side of the mounting device 32. Thus, the back portion of the arrow rest 2 will now be the front portion and the front portion is now the back portion. The arrow rest 2 can now be mounted on the left side of the bow shaft.

In other embodiments, the arrow rest 2 can be modified for a left-handed user by turning the arrow rest 2 upside down so that the mounting device 32 is to the right of the arrow rest 2. The openings at the base 4 of the arrow rest 2, used to accommodate the arms 6 and the stops 8, may run completely through the base 4. By disengaging the spring 12 from the spring holding device 14, the arms 6 can be removed from the base 4. The stops 8 can be pushed through to protrude out the other side of the base 4, the "new" top side. The spring holding device can be rotated 180°. The arms 6 can be placed in the openings on the new top side of the base 4 and the spring 12 re-engaged in the spring holding device 14. The arrow rest 2 can be adjusted in the mounting device as described above and/or the wheels 24 can be adjusted with the adjustment device 28, as needed.

The arrow rest 2, 52 and mounting device 32 may be made of metal, metal alloys, and/or plastic. For example, aluminum may be used for the base 4 as it is strong and lightweight. Spring steel may be used for the arms 6 as it is malleable under sufficient, deliberate pressure, but not under ordinary, casual pressure. With spring steel, slight adjustments can be made to the configuration of the arms 6. The appropriate material or materials for the arrow rest 2, 52 and the mounting device 32 will be apparent to those skilled in the art.

Figure 7A:
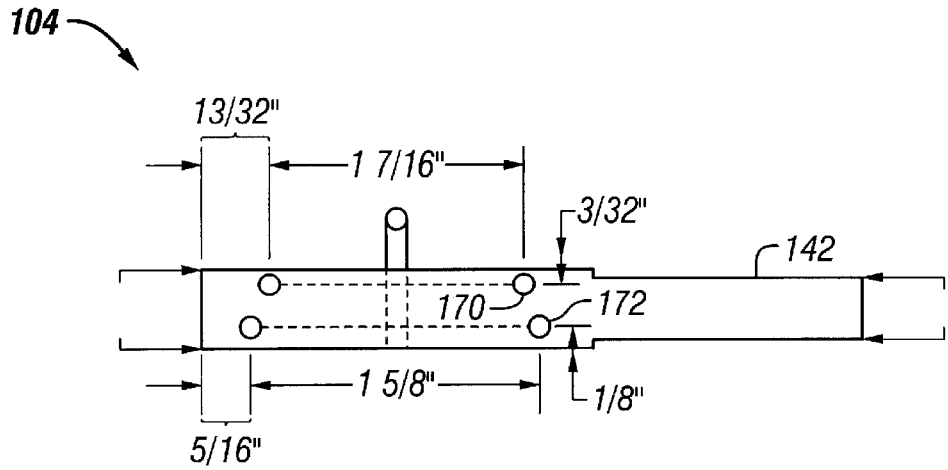
FIGS. 7A–D are top, front, and end views, respectively, of the base of one embodiment of the invention.
Figure 7B:
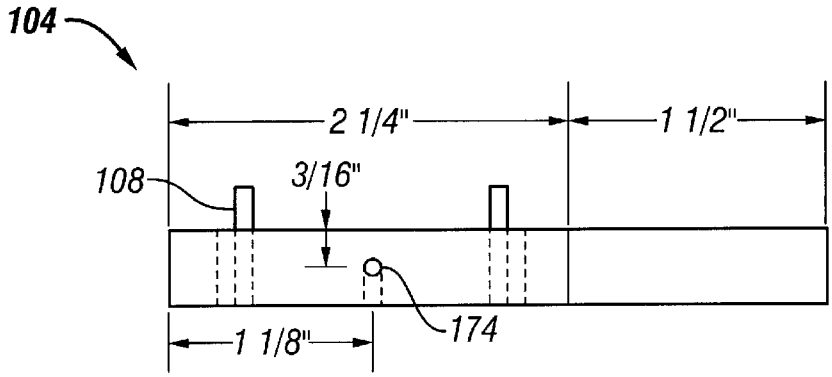
Figure 7C:
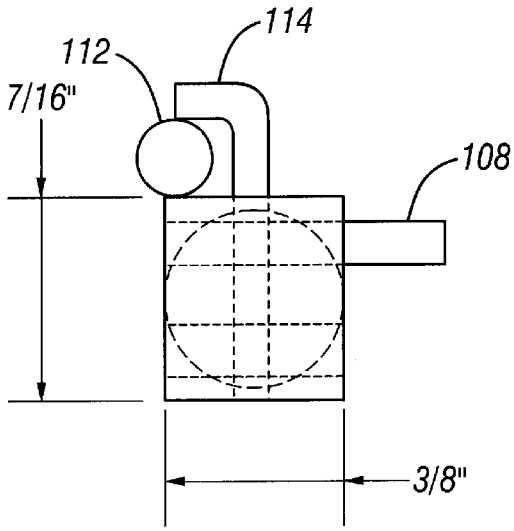
Figure 7D:
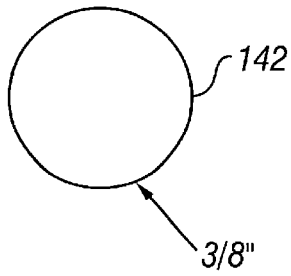

FIG. 7A is a top view of a base 104 of one embodiment of the invention. FIG. 7B is a front view of the base 104. FIGS. 7C and 7D are end views of the base 104. FIG. 7C shows a spring 112 being retained by the spring holder 114. In this embodiment, the diameter of the cylindrical appendage 142 can be ⅜ of an inch. Shown in FIG. 7A are the openings 170 for the stops 108, openings 172 for the arms 106, and opening 174 for the spring holding device 114.

Figure 8A:
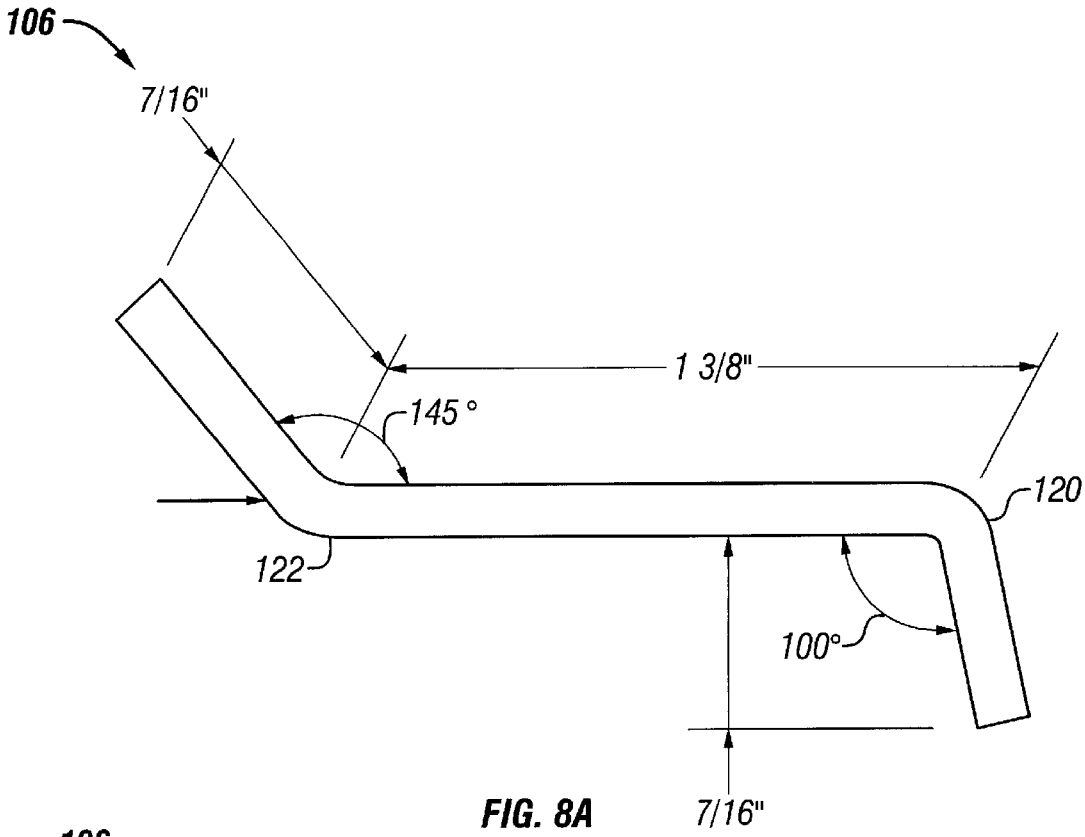
FIGS. 8A and 8B are side and top view, respectively, of the arms of one embodiment of the invention.
Figure 8B:
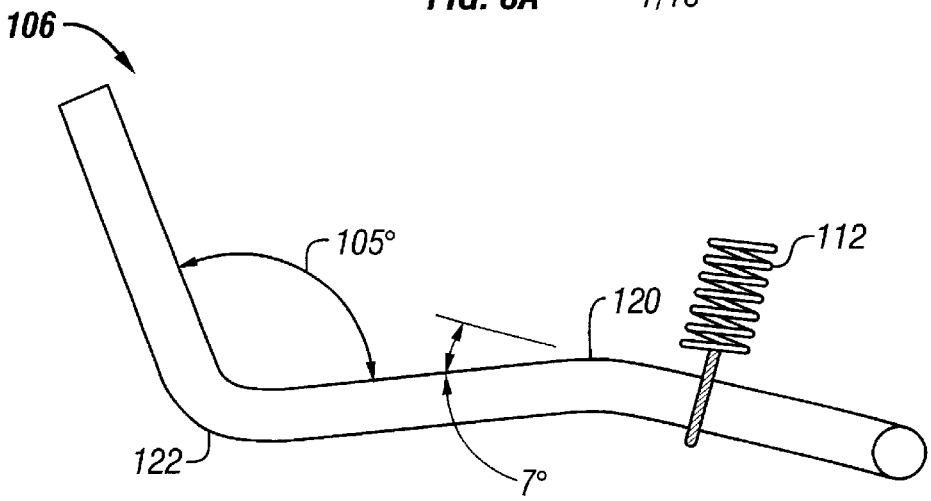
Figure 8C:
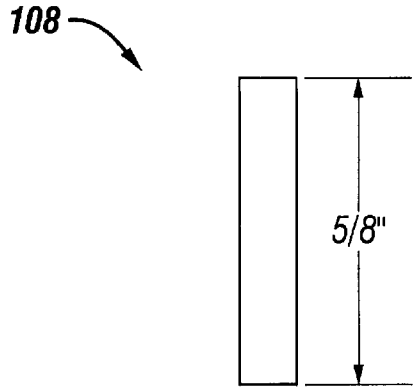
FIG. 8C is a side view of a stop of one embodiment of the invention.
Figure 8D:
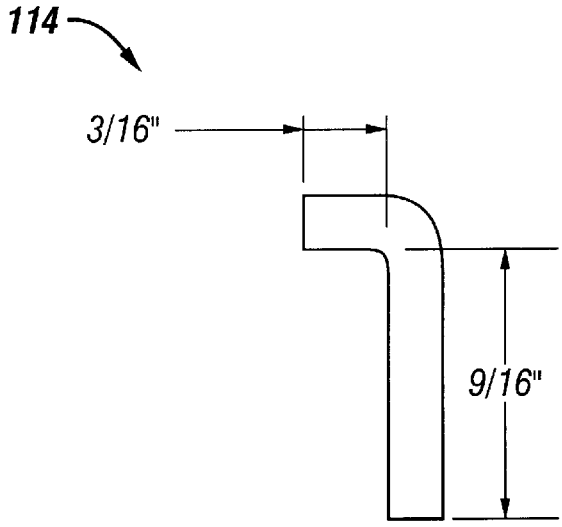
FIG. 8D is a side view of a spring holder of one embodiment of the invention.

FIG. 8A is a side view of an arm 106 of one embodiment of the invention. FIG. 8B is a top view of the arm 106. FIG. 8C is a side view of a stop 108 of one embodiment of the invention. FIG. 8D is a side view of a spring holder 114 of one embodiment of the invention. In this embodiment, the arms 106, stops 108, and spring holder 114 can be made of spring steel and be of 0.091 inches in diameter. Accordingly, the opening 170 for the stops 108 and the opening 174 for the spring holder 114 can be formed by drill #43, creating a 0.089 diameter opening. The opening 172 for the arms 106 can be formed from a drill creating a 3/32 of an inch in diameter opening. The opening 172 for the arms 106 are slightly larger to allow the arms 106 to pivot freely in the base 104. FIGS. 8A and 8B show one possible configuration for the arms 106. This embodiment shows a first bend 120 and a second bend 122.

Figure 9:
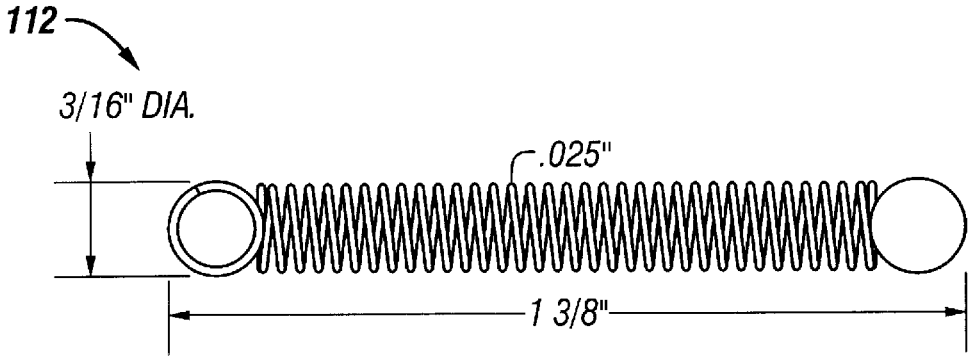
FIG. 9 is a side view of a spring of one embodiment of the invention.

FIG. 9 shows one possible elastically compliant, resilient member of the invention. The spring 112 is approximately 1⅜ inches in length, 3/16 inch in diameter at the portion to be used to couple the spring 112 to the arms 106. The diameter is approximately 0.025 inches in diameter. In one aspect, when the arrow rest is fully assembled, the lateral pull at the wheel center can be approximately about 3 to about 5 oz., but this can vary to suit the circumstances when paper tuning. Paper tuning is one process of ensuring that the arrow is flying true.

Figure 10A:
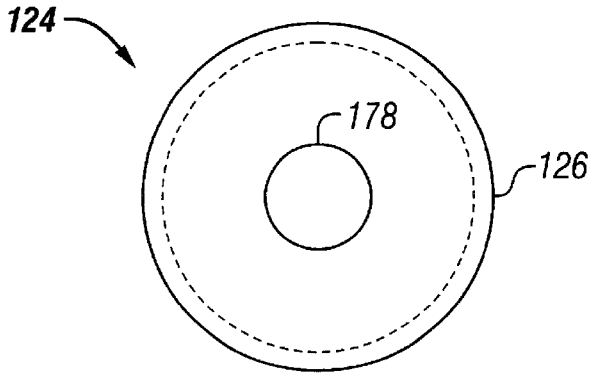
FIGS. 10A and 10B are front and side views, respectively, of one embodiment of the invention.
Figure 10B:
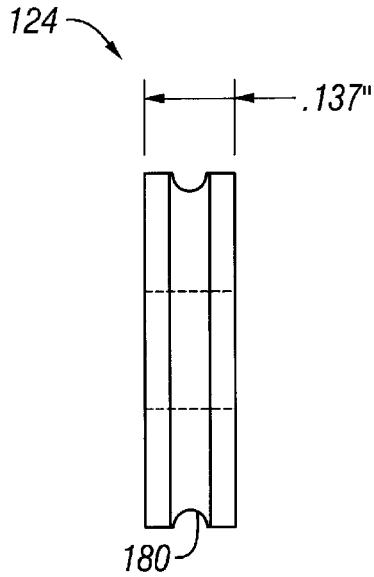
Figure 10C:
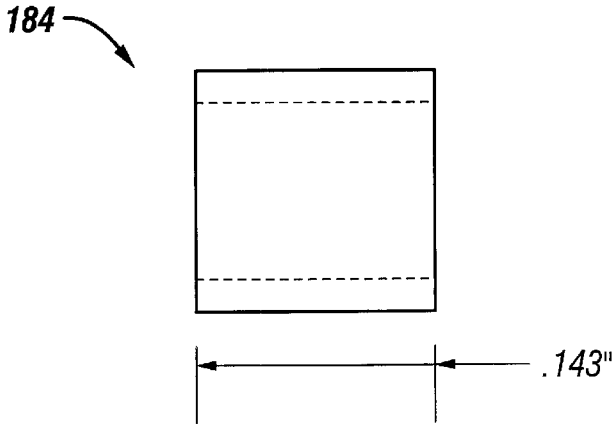
FIGS. 10C and 10D are side and front views, respectively, of one embodiment of the invention.
Figure 10D:
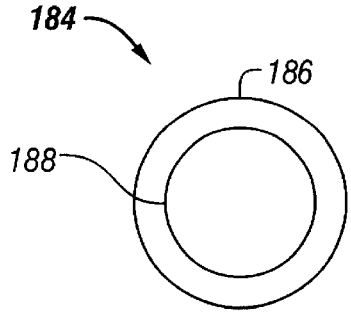

FIGS. 10A and 10B show a top view and a side view, respectively, of a wheel 124 in one embodiment of the invention. The wheel 124 can be made of delron or nylon, although many other materials can be used. FIG. 10B shows a groove 180 where a band of material, such as a tire 126 can be placed. An opening 178 can be to accommodate a wheel bushing 184. FIGS. 10C and 10D show a side and front view, respectively, of one example of a wheel bushing. In this embodiment, the material can be brass. The outer diameter 186 is about 0.1585 inch. The internal opening 188 is 0.111 inch in diameter to accommodate a 4–40 bolt. The bolt can be ¼ of an inch long and be used with #4 washers. A precision bearing allows movement without excessive space between the bearing surfaces, for example, in this case, the brass bushing 184 would be about 0.002 inches smaller than the wheel 124 with a tolerance of about +/−0.001 inches.

Figure 11A:
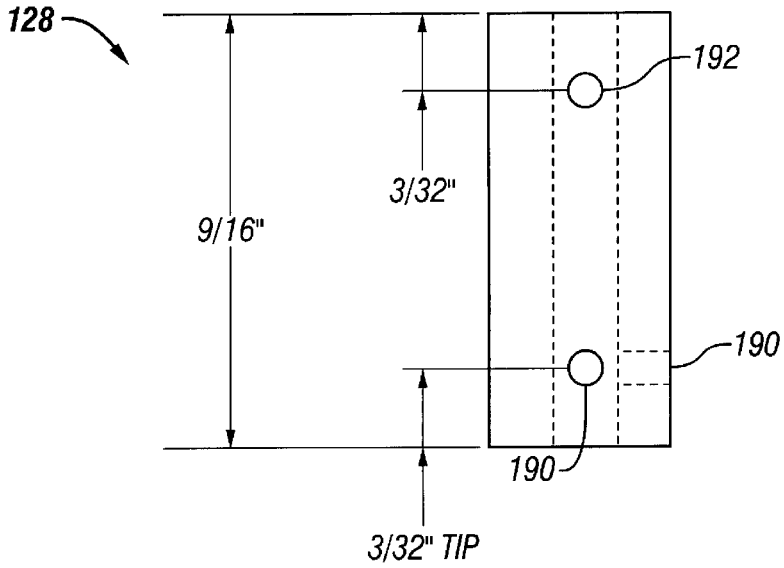
FIGS. 11A and 11B are side and front views, respectively, of one embodiment of the invention.
Figure 11B:
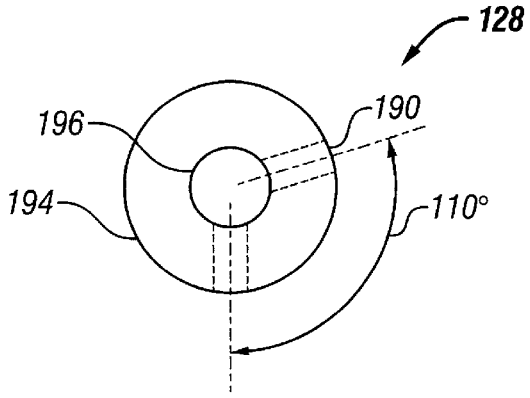

FIGS. 11A and 11B show a side and front view of an adjustment device 128 according to one embodiment of the invention. The adjustment device 128 can be a ¼ inch brass round bar. A hole 196 can be created having a 3/32 inch diameter, to create a barrel. Two opening 190 are created, drill and tap 4-40 to accommodate 4-40 Allen set screws of about 3/16 of an inch long. Another opening 192 is created, drill and tap 4-40 for a wheel bolt. The adjustment device 128 is placed on the arm 106. To adjust the adjustment device 128 on the arm 106, loosen the two Allen set screws so as to allow the adjustment device to moved along the arm 106. The adjustment device 128 can be rotated about the axis of the arm 106 as well as along the length of the arm 106. Adjusting the adjustment device 128 will also affect the placement of the wheels 124. Once the wheels 124 are in the desired position, the Allen set screws are tightened to hold the adjustment device 128 in place on the arm 106.

Figure 12B:
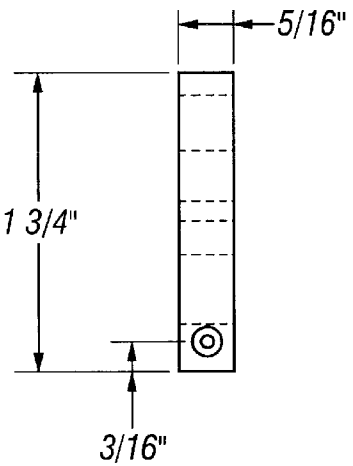
FIGS. 12A and 12B are front and side views, respectively, of one embodiment of the invention.
Figure 12A:
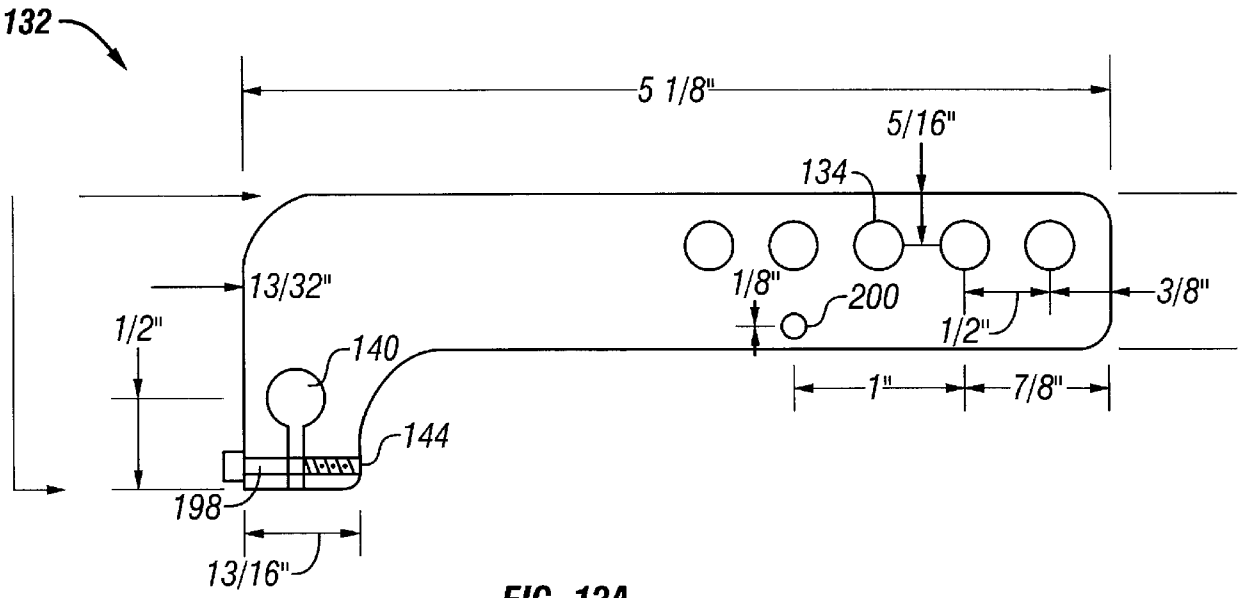

FIGS. 12A and 12B show a front and side view, respectively of the mounting element 132 according to one embodiment of the invention. The opening 134 for attachment to the riser of the bow can be about 5/16$^{th}$ of an inch in diameter. Openings 200 can be drill and taped for 6-32 set screws. The opening 140 to receive the arrow rest can be about 3/8$^{th}$ of an inch to accommodate a cylindrical appendage. An opening 198 can be created by a 5/32$^{nd}$ of an inch body drill to accommodate a 6-32 Allen bolt 144.

According to the present invention, an improved arrow rest is provided that is simple in design and economical to manufacture. The arrow rest includes a base and two arms pivotally coupled to the base. The ability of the arms to move laterally, in a generally horizontal or vertical manner, allows the arrow to yield to the deflections of the arrow from the force of the bowstring upon release. In this manner, the arrow rest provides support and stability without introducing forces of its own to interfere with the flight of an arrow. The arms' ability to yield to forces exerted by the arrow also reduces wear on the wheels. Moreover, the lateral movements of the arms protect the integrity of the arrow rest during use. For example, should the arm accidentally get caught in a branch as one is walking through the woods, the arm will accommodate for this sudden restriction of forward movement by pivoting outward. Should the arms become distorted, however, the user can, by exerting sufficient pressure on the arms, realign them.

Having described preferred and exemplary embodiments of the invention, it will be apparent to those of ordinary skill in the art that other embodiments incorporating the concepts disclosed herein can be used without departing from the spirit and scope of the invention. The described embodiments are to be considered in all respects only as illustrative and not restrictive.

What is claimed is:

1. An arrow rest comprising:

(a) a base; and (b) a pair of opposing arrow-supporting arms pivotally coupled to the base, wherein the arms respond independently to an arrow's flight.

2. The arrow rest of claim 1, wherein the arms further comprise a wheel at a distal end of each arm.

3. The arrow rest of claim 2, wherein the wheel is coupled to the arm by a wheel adjustment device.

4. The arrow rest of claim 1 further comprising an elastically compliant, resilient member coupled to the arms for biasing the arms to a home position.

5. The arrow rest of claim 4, wherein the home position is defined by a stop.

6. The arrow rest of claim 1, wherein the arms pivot in a generally lateral direction in relation to the base in response to a force exerted on the arms by the arrow's flight.

7. The arrow rest of claim 1 further comprising a mounting device.

8. The arrow rest of claim 7, wherein the mounting device is adjustable.

9. An arrow rest comprising:

(a) a base; and (b) a pair of opposing arrow-supporting arms pivotally coupled to the base, wherein the arms move in a generally lateral direction with respect to the base.

10. An arrow rest comprising:

(a) a base;

(b) a pair of arrow supporting arms pivotally coupled to the base;

(c) a pair of wheels, each wheel coupled to a distal end of the arms;

(d) a stop coupled to the base defining a home position for the arms; and (e) an elastically compliant, resilient member coupled to each arm for biasing the arms to the home position.

* * * * *